US008985484B2

(12) United States Patent
Eley et al.

(10) Patent No.: US 8,985,484 B2
(45) **Date of Patent: *Mar. 24, 2015**

(54) SPRAY GUN ATTACHMENT FOR A FLUID HANDLING SYSTEM

(75) Inventors: Craig D. Eley, Lincoln, NE (US); Darin Schollmeyer, Creighton, NE (US)

(73) Assignee: Eley Corporation, Lincoln, NE (US)

( * ) Notice: Subject to any disclaimer, the term of this patent is extended or adjusted under 35 U.S.C. 154(b) by 691 days.

This patent is subject to a terminal disclaimer.

(21) Appl. No.: 13/311,296

(22) Filed: Dec. 5, 2011

(65) Prior Publication Data

US 2013/0140382 A1 Jun. 6, 2013

(51) Int. Cl.
*B05B 7/02* (2006.01)
*B05B 9/01* (2006.01)
*B05B 15/06* (2006.01)

(52) U.S. Cl.
CPC ..... *B05B 9/01* (2013.01); *B05B 15/066* (2013.01)
USPC ..... 239/525; 239/390; 239/397; 239/587.1; 239/588; 239/600; 285/98; 285/272; 285/278; 285/279; 285/280

(58) Field of Classification Search
CPC ..... B05B 15/065; B05B 1/1654; B05B 1/16; B05B 9/01; B05B 12/002; B05B 15/066; B05B 15/067; B65D 83/7532; F16L 27/0861; F16L 27/0828; F16L 27/0832; F16L 27/0816; F16L 27/08; F16L 27/0824; F16L 27/0812; F16L 27/00; F16L 27/082; E03C 1/06; E03C 1/0408; E03C 1/0404; E03C 1/0401
USPC ..... 239/390, 391, 397, 525, 526, 587.1, 239/587.2, 588, 600; 285/98, 272, 274, 285/276, 278, 279, 280; 4/596, 615, 678
See application file for complete search history.

(56) References Cited

U.S. PATENT DOCUMENTS

| | | | | |
|---|---|---|---|---|
| 3,744,721 | A * | 7/1973 | Baumstark, Jr. | 285/98 |
| 4,500,119 | A * | 2/1985 | Geberth, Jr. | 285/276 |
| 6,050,508 | A * | 4/2000 | Fan | 239/587.1 |
| 6,199,227 | B1 * | 3/2001 | Chen | 239/587.1 |
| 6,752,433 | B2 * | 6/2004 | Frost | 285/98 |
| 2009/0008934 | A1 * | 1/2009 | Matzner et al. | 285/276 |
| 2012/0145813 | A1 * | 6/2012 | Kozey | 239/600 |

* cited by examiner

*Primary Examiner* — Steven J Ganey
(74) *Attorney, Agent, or Firm* — Perkins Coie LLP

(57) ABSTRACT

A spray gun attachment is provided for fluid supply lines in a fluid handling system. A fluid input portion of a gun body is coupled wife a swivel connector, which includes a rotor that is rotatably coupled with a housing stem. In various embodiments, a bearing cup is rotatably coupled at one end with an exterior surface of the housing stem and anchored at an opposite end with the rotor. An O-ring seal is positioned between the rotor and the exterior surface of the housing stem. A bearing assembly residing within a raceway that is defined by flat surfaces on each of: the rotor, the housing stem, and ah interior bearing wall within the bearing cup.

22 Claims, 6 Drawing Sheets

SPRAY GUN ATTACHMENT FOR A FLUID HANDLING SYSTEM

BACKGROUND

Garden hose spray guns typically attach to the ends of garden hoses using mating threads, which are fixed in position with respect to the input ends of the spray gun bodies. A common problem with this arrangement however, is that it limits the tree movement of the spray gun in the user's hand. It is, therefore, desirable to provide a spray gun that may pivot independently of the garden hose and not restrict the free movement of the user during normal cleaning or watering chores. It is contemplated that the addition of a quick coupler could provide the general affect of a swivel but such an arrangement is not designed to withstand the constant movement and pressure that it would endure during common usage. In the end, such a design will tend to leak very easily.

It is contemplated that a swivel connector could be used with a spray gun connector. However, in many prior art swivel designs, the rotor and housing rotate with respect to one another in a less than accurate fashion. Frequently, there is a fair amount of concentric play between the rotor and the housing, which is a significant contributor to leaks. In an attempt to provide a swivel that does not leak, various prior art designs increase the pressure on the O-ring seals within the swivel assembly. One problem with this design approach, however, is that the increased pressure on the O-rings also increases the torque required to rotate the swivel. This oftentimes causes premature wear on the O-rings, which can shorten the life of the swivel and cause premature leaking; the very condition the design sought to avoid. Moreover, such increased torque in prior designs can cause the user's hose to kink.

Prior swivel designs are also difficult to assemble. Conventional designs typically include an interrupting feature in the bearing raceway, such as a bearing opening that is cross-drilled into the raceway. Such a design makes it more difficult to assemble, which will cause an end user trouble when it is time to replace a tailed O-ring seal. This may happen routinely, increasing the operational costs to the user. With prior art designs, this is a fairly complicated repair in the field and may cause more problems than it resolves.

Another design shortcoming with the bearing raceways of prior swivel designs is the level of operational friction generated by the raceways during use. Conventional raceway designs are mostly circular in cross-section and sized just larger than the diameter of the bearings used therein. Accordingly, each bearing within such a raceway engages the surface of the raceway around an entire circumferential portion of the bearing. When multiplied by several bearings within a single swivel design, the amount of friction becomes significant. Moreover, such designs typically require high precision machining, which increases manufacturing costs and the potential for faulty swivel assemblies.

Standard pistol grip gun designs further suffer from restricted flow due to the types of valves used. This restriction can be acute and severely affect the amount of water available for cleaning or watering operations. Accordingly, it is desirable to create a spray gun that does not restrict the available water flow or pressure.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

A spray gun attachment of the present technology is provided for use within a wide array of fluid handling systems that will incorporate the use of one or more fluid delivery lines. Generally, the spray gun attachment will include an elongated gun body, having an open inlet end portion and an open outlet end portion. A swivel connector is coupled to the inlet end portion of the gun body. The swivel connector includes a housing stem, having an open first end portion and an open second end portion, and a rotor, having an open first end portion and an open second end portion, which is coupled with the gun body. The second end portion of the housing stem is placed in open fluid communication with the first end portion of the rotor, which is positioned so that the rotor and gun body may freely rotate with respect to the housing stem on a common axis extending through a length of the housing stem.

The swivel connector may include a bearing cup, having an open opposite end portion and an open interior portion. In some embodiments, a rotor end portion of the bearing cup is coaxially, rotatably coupled with an exterior surface of the rotor. A threaded inner diameter of the opposite, housing stem end portion of the bearing cup is coupled with a threaded portion of an exterior surface of the housing stem, allowing the bearing cup to be advanced and withdrawn along a length of the housing stem to a desired position. A lock ring is provided to secure the position of the bearing cup along the threaded portion of the housing stem. In some embodiments, a bearing assembly is disposed within a bearing raceway, which is defined by a bearing channel in the exterior surface of the rotor, a bearing wall in the second end portion of the housing stem, and an interior bearing wall within the interior portion of the bearing cup. In some embodiments, at least portions of the bearing channel, bearing wall, and interior bearing wall are provided with flat engagement faces, which are positioned to engage each of the bearings of the bearing assembly at tour discrete points.

An O-ring seal is positioned between the housing stem and the rotor, whereby the passage of fluid from a fluid pathway of the housing stem to the interior portion of the bearing cup is substantially prevented. In some embodiments, the O-ring seal is positioned within an annular recess within one of the rotor or housing stem. In this position, the O-ring seal may be easily replaced in the field by a user.

Various embodiments of the spray gun attachment include a grip that at least partially surrounds the gun body and the swivel connector. The grip may be formed from a wide array of materials according to the desired use and durability of the spray gun attachment. The grip is ergonomically shaped to fit within a user's hand, including a slightly curved spine, which is received within a user's palm, and recesses that receive the user's fingers.

In various embodiments, the spray gun attachment is provided with a spray tip adapter at the outlet end portion of the gun body. The spray tip adapter may be provided as a separate, removable component mat is secured with the outlet end portion of the gun body. An outlet end portion of the spray tip adapter is configured to receive the input end portion of a spray tip.

In other embodiments, the spray gun attachment includes an elongated gun body formed from multiple components. In particular, a connector tube, having an open first end portion and an open second end portion, is provided to extend up the grip portion of the spray gun attachment; the first end portion defining the open inlet end portion of the gun body. A head portion, having an open first end portion and an open second portion, is provided to extend along the "barrel" portion of the spray gun attachment; the second end portion defining the open outlet end portion of the gun body. The second end portion of the connector tube is coupled, with the first end portion of the head portion.

In various embodiments of the spray gun attachment, the grip at least partially surrounds the gun body and the swivel connector. In some respects, the grip position provides a degree of security to the point of connection between the gun body and the swivel connector. The grip may be formed from a wide array of materials according to the desired use and durability of the spray gun attachment. While it is contemplated that some materials may permit the grip to be overmolded onto the gun body, some embodiments of the spray gun attachment use a grip that is bifurcated longitudinally into separate grip halves. Mechanical fasteners, such as screws, may be used to secure the opposing grip halves with one another.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a pan hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

With reference to FIGS. 1-6, spray gun attachments of the present technology may be used within a wide array of fluid handling systems. It is contemplated that the fluid handling systems may be used in various operations that involve the handling of water, lubricants, adhesives, coolants, solvents, various gases, and other similar fluids. It will be understood by those skilled in the art that, as the application of the system is changed for the handling of different fluids, the materials used, such as the nature and grade of fluid lines used, will change accordingly. However, for purposes of description only, the fluid handling system and the spray gun attachments, more specifically, will be described as it would be used for the handling of water in a residential application.

Figure 1:
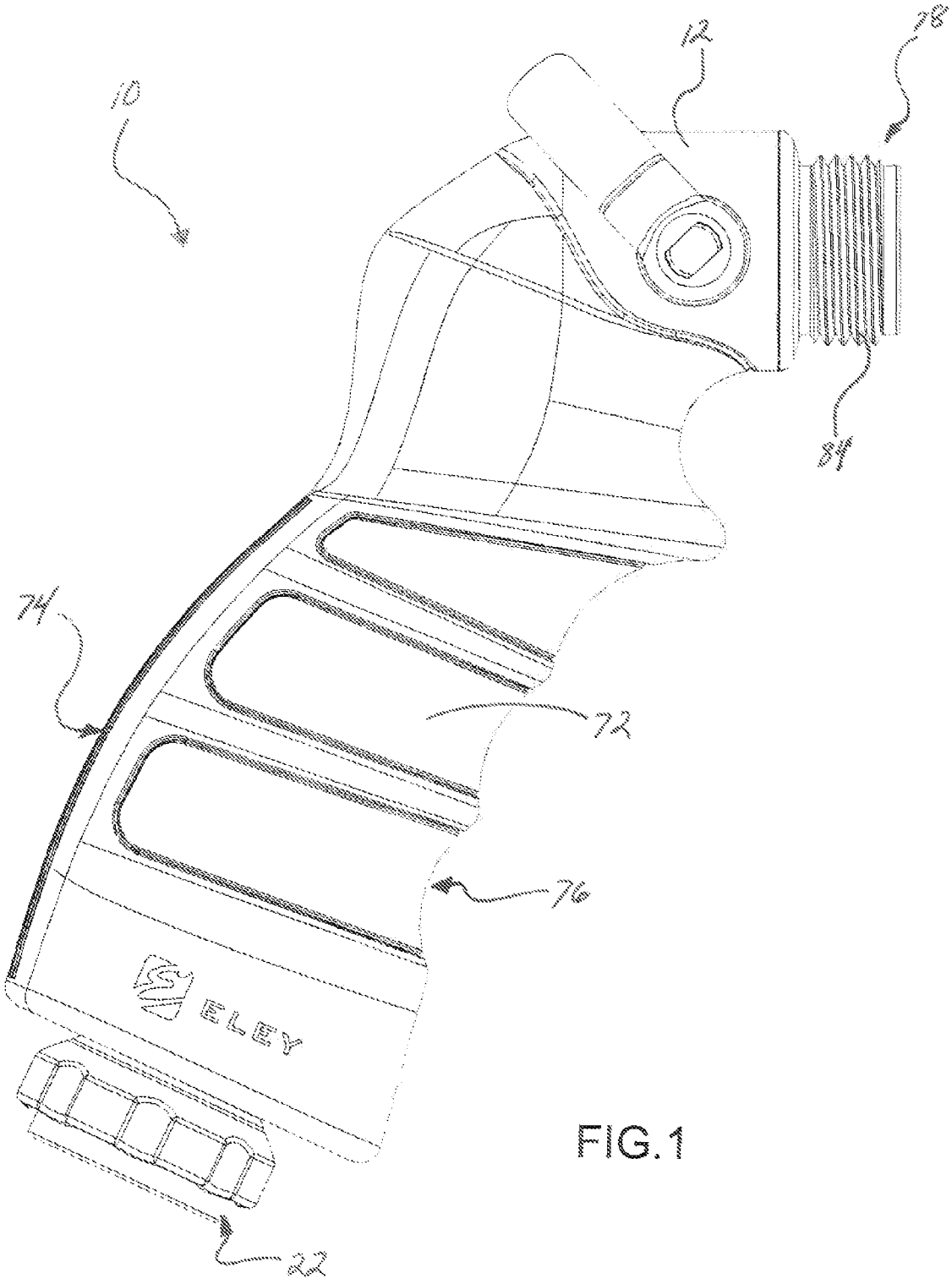
FIG. 1 depicts a side, elevation view of one embodiment of the spray gun attachment of the present technology.
Figure 2:
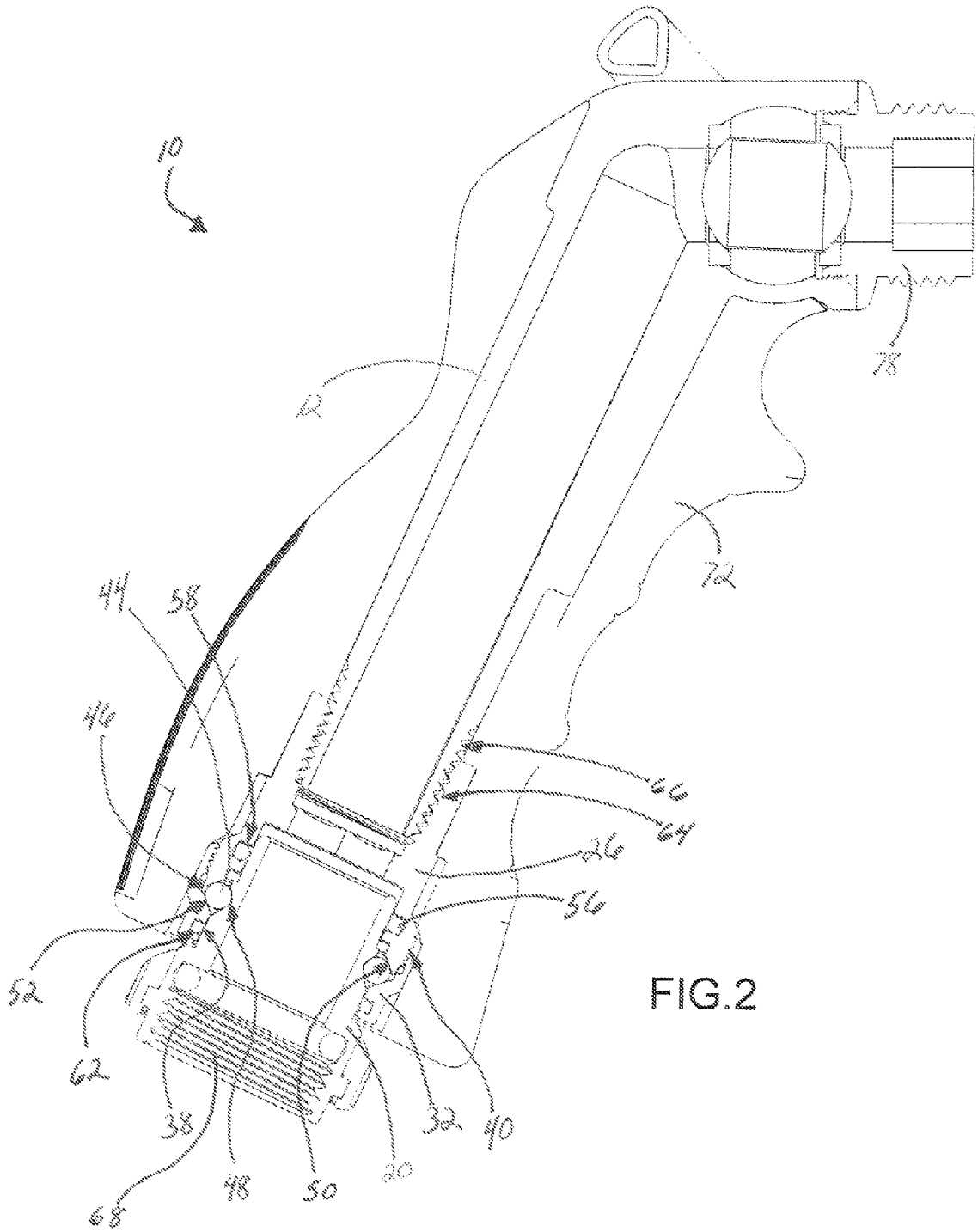
FIG. 2 depicts a cutaway view of the spray gun attachment depicted in FIG. 1.
Figure 3:
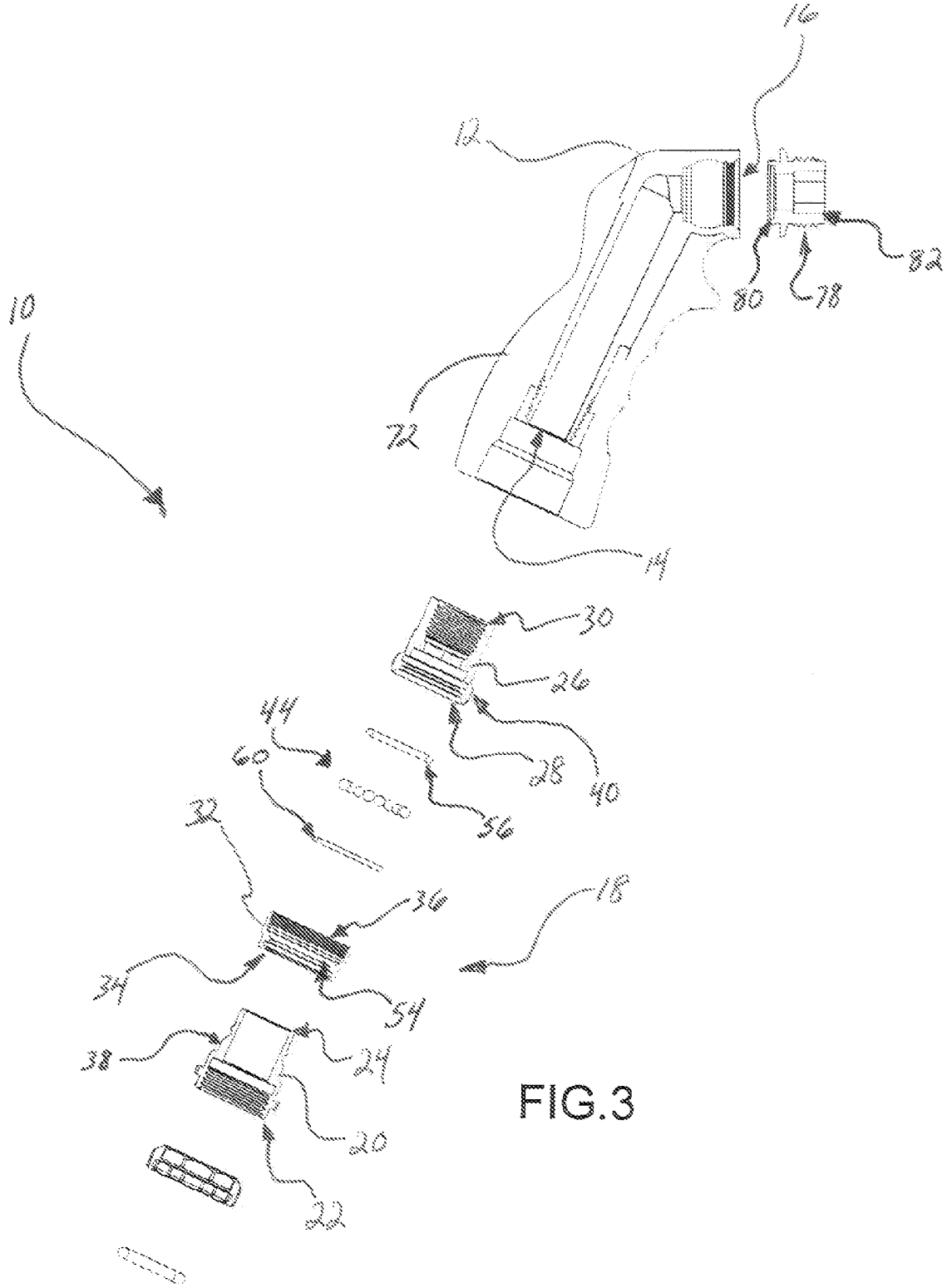
FIG. 3 depicts an exploded view of the spray gun attachment depicted in FIG. 1.

With reference to FIGS. 1-3, the spray gun attachment 10 of the present technology will include an elongated gun body 12, having an open inlet end portion 14 and an open outlet end portion 16. A fluid pathway extends between the open inlet end portion and the open fluid outlet end portion. FIGS. 1-3 depict the inlet end portion 14 and the outlet end portion 16 being disposed at an angle with respect to one another so that the gun body 12 is angled to resemble a pistol shape. In this manner, one may envision that the inlet end portion would be positioned within the grip of the pistol and the outlet would be positioned at the end of the barrel of the pistol. It is contemplated that the angle at which the gun body is disposed may be set at nearly any angle (including ho angle to provide a straight gun body), without departing from the scope of the present technology.

The gun body 12 may be formed from a wide array of different materials, depending on the intended use and desired durability of the spray gun attachment 10. For example, metals such as brass, aluminum, steel, and various metal blends will provide strength and durability. However, it is contemplated that various plastics may provide suitable durability and uses in particular applications while reducing overall weight and cost. It is further contemplated that the gun body 12 may be formed from unitary construction or as an assembly of two or more component parts.

With reference to FIGS. 2 and 3, a swivel connector 18 will include a housing stem 20, having an open first end portion 22 and an open second end portion 24. An open fluid pathway extends between the first end portion 22 and the second end portion 24. The swivel connector IS will further include a rotor 26, having an open first end portion 28 and an open second end portion 30. An open fluid pathway extends between the first end portion 28 and the second end portion 30. The second end portion 24 of the housing stem 20 is placed in open fluid communication with the first end portion 28 of the rotor 26, whereby the open fluid pathway of the rotor 26 is in open fluid communication with the fluid pathway of the housing stem 20. However, in some embodiments, the second end portion 24 of the housing stem 20 is positioned to reside at least partially within the first end portion 28 of the rotor 26. In this position, the second end portion 24 of the housing stem 20 and the first end portion 28 of the rotor 26 are positioned so that the rotor 26 freely rotates with respect to the housing stem 20 on a common axis extending through a length of the housing stem 20.

In various embodiments, the swivel connector 18 will include a bearing cup 32, having an open housing stem end portion 34 and an open rotor end portion 36. With reference to FIG. 2, the housing stem end portion 34 of the bearing cup 32 is coaxially, rotatably coupled with an exterior surface 38 of the housing stem 20 between the first end portion 22 and second end portion 24 of the housing stem 20. A threaded inner diameter of the rotor end portion 36 of the bearing cup 32 is coupled with a threaded portion 40 of an exterior surface 42 of the rotor 26, adjacent the first end portion 28 of the rotor 26, allowing the bearing cup 32 to be advanced and withdrawn along a length of the rotor 26 to a desired position. In some embodiments, an adhesive, such as Threadlocker from Loctite, may be used to secure the position of the rotor end portion 36 of the bearing cup 32 with respect to the threaded portion 40 of exterior surface 42 of the rotor 26.

A bearing assembly 44 is disposed within a bearing raceway 46. In various embodiments, the bearing raceway 46 is defined by a bearing channel 48 in the exterior surface 38 of the housing stem 20, a bearing wall 50 in the first end portion 28 of the rotor 26, and an interior bearing wall 52 within an interior portion 54 of the bearing cup 32. Specifically, in some embodiments, at least portions of the bearing channel 48, bearing wall 50, and interior bearing wall 52 are provided with flat engagement faces. The bearing channel 48, for example, may be formed to have flat, opposing first and second walls that define a V-shape. Similarly, the bearing wall 50 in the first end portion 28 of the rotor 26 and the interior bearing wall 52 within the interior portion of the bearing cup 32 may be provided as flat faces that oppose one another, generally defining a V-shape that is open toward an open end portion of the bearing channel 48 when the components of the bearing raceway 46 are each positioned in an assembled position. The bearing assembly 44 will include a plurality of bearings 50, which can be made from several different materials, such as hardened or stainless steel, or a plastic, such as Acetyl.

The design of the bearing raceway 46 dictates that the bearings 50 within the bearing raceway 46 need only to provide for axial load and not radial load. Prior swivel connector designs used the bearings within the assembly for both axial and radial loads. The self-centering nature of the housing stem 20, rotor 26 and the bearing cup 32 supplies the radial load to the swivel connector 18 so that the bearings 50 can fit more loosely within the bearing raceway 46 and not affect the sealing nature of any O-rings disposed within the swivel connector 18.

In various embodiments, an O-ring seal 56 is positioned between the rotor 26 and the exterior surface 38 of the housing stem 20, whereby the passage of fluid from the fluid pathway of the housing stem 20 to the interior portion 54 of the bearing cup 32 is substantially prevented. In some embodiments, the O-ring seal 56 is positioned within an annular recess 58 formed in an interior surface of the rotor 26, adjacent the first end portion 28 of the rotor 26. In this position, the O-ring seal 56 may be easily replaced in the field by a user. The bearing cup 32 is unthreaded from the rotor 26, which allows the withdrawal of the rotor 26 and exposes the open first end portion 28 of the rotor 26. The O-ring seal 56 may then be easily inspected and replaced. With a reassembly of the component parts to the swivel connector 18 in reverse order of the disassembly steps, the task of inspecting and replacing the O-ring seal 56 may be accomplished by a user in the field in a couple of minutes or less.

In various embodiments, the swivel connector 18 includes an O-ring dust seal 60 that is disposed between the exterior surface 38 of the housing stem 20 and the housing stem end portion 34 of the bearing cup 32. In some embodiments, the O-ring dust seal 60 is at least partially disposed within an annular recess 62 formed within an interior surface of the bearing cup 32. A sealing surface of the O-ring dust seal 60 engages the exterior surface 38 of the housing stem 20 as the rotor 26 and bearing cup 32 rotate. The size and material of the O-ring dust seal 60 is chosen to simply provide a sufficient seal to substantially prevent dirt and other debris from entering the interior portion 54 of the bearing cup 32 and coming into contact with the bearing assembly 44.

The second end portion 30 of the rotor 26 may be provided with mating threads 64 to engage mating threads 66 associated with the inlet end portion 34 of the gun body 12. It is contemplated, however, that the gun body 12 and the swivel connector 18 could be secured together through a friction-fit engagement of the two opposing structures, an adhesive, or one of various mechanical fasteners. Irrespective of the manner in which the opposing structures are secured with one another, the spray gun attachment 12 is secured to, and permitted to rotate with, the rotor 26 with respect to the housing stem 20. Inlet mating threads 68 or other mechanical fastener features may be associated with an interior portion of the housing stem 20, adjacent the first end portion 22 of the housing stem 20. The inlet mating threads 68 may be coupled with a terminal end portion of a fluid supply line 70 that extends from a fluid source, such as a faucet. With a fluid supply line coupled with the first end portion 22 of the housing stem 20, a user may grasp the spray gun body 12 and freely pivot the spray gun body 12 with respect to the fluid supply line 70.

The spray gun attachment 10 may be provided with one of various known valve mechanisms for metering the flow of fluid through the gun body 12. Such valve mechanisms may be associated with one or more trigger assemblies that are configured so that a user may engage the trigger assembly and actuate the valve mechanism between an open position, a closed position, and points therebetween.

With reference to FIGS. 1-3, various embodiments of the spray gun attachment 10 will be provided with a grip 72. In some embodiments, the grip 72 at least partially surrounds the gun body 12 and the swivel connector 18. In some respects, the grip position provides a degree of security to the point of connection between the gun body 12 and the swivel connector 18. The grip 72 may be formed from a wide array of materials according to the desired use and durability of the spray gun attachment 10. For example, the grip 72 may be formed from various plastic or metal materials. However, one of various natural and synthetic rubber materials, closed and open cell foams, and the like, will provide a grip 72 that is at least semi-deformably resilient and comfortable for users to grip. Such materials may also be over-molded onto the gun body of ease of assembly. Regardless of the materials from which the grip 72 is formed, the grip 72 will be economically shaped to fit within a user's hand, including a slightly curved spine 74, which is received within a user's palm, and recesses 76 that receive the user's fingers.

In various embodiments, the spray gun attachment 10 is provided with a spray tip adapter 78 at the outlet end portion 16 of the gun body 12. In at least some embodiments, the spray tip adapter 78 is provided as a separate, removable component that is secured with the outlet end portion 16 using mating threads or other suitable mechanical fasteners. The spray tip adapter, in such embodiments, will include an open first end portion 80, which is adapted to securably engage the output end portion 16. An open second end portion 82 includes tip mating threads 84 or other mechanical fasteners that are configured to receive the mating threads of a spray tip. In some embodiments, the tip mating threads 84 are provided to have an outer diameter commensurate with "GHT" or the Garden Hose Standard of approximately 1.0625 inches (27.0 mm), which will accommodate the inner diameter of most of the shelf garden hose spray tips and accessories. However, it is contemplated that the second end portion 82 may be provided in nearly any shape and configuration to receive different attachments in a wide array of applications. The removable nature of the spray tip adapter enables the user to replace the spray tip adapter 78 or exchange it for an alternate adapter. However, providing the spray tip adapter 78 as a removable component further provides relatively quick and easy access to the interior portion of the gun body 12, adjacent the outlet end portion 16. In this manner, components associated with the spray gun valve may be easily installed or serviced.

Figure 4:
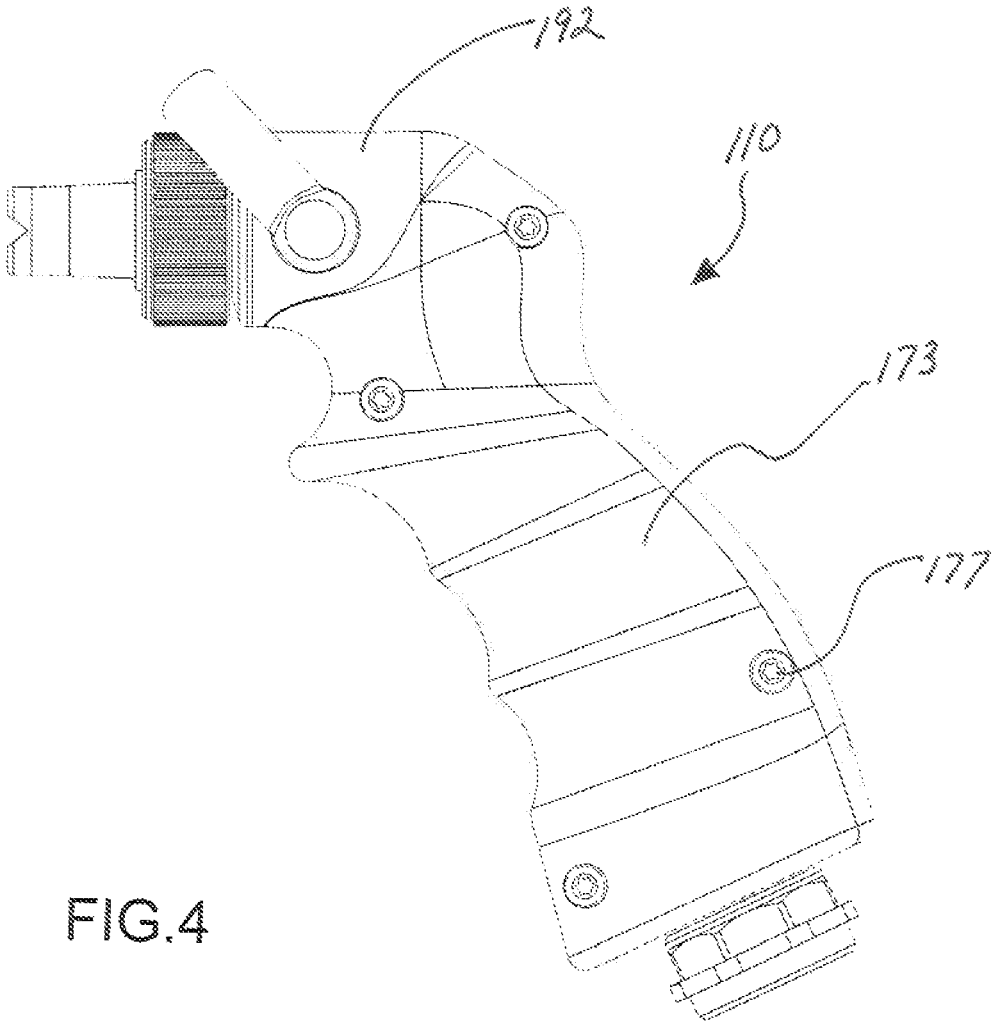
FIG. 4 depicts a side elevation, cutaway view of another embodiment of the spray gun attachment of the present technology.
Figure 5:
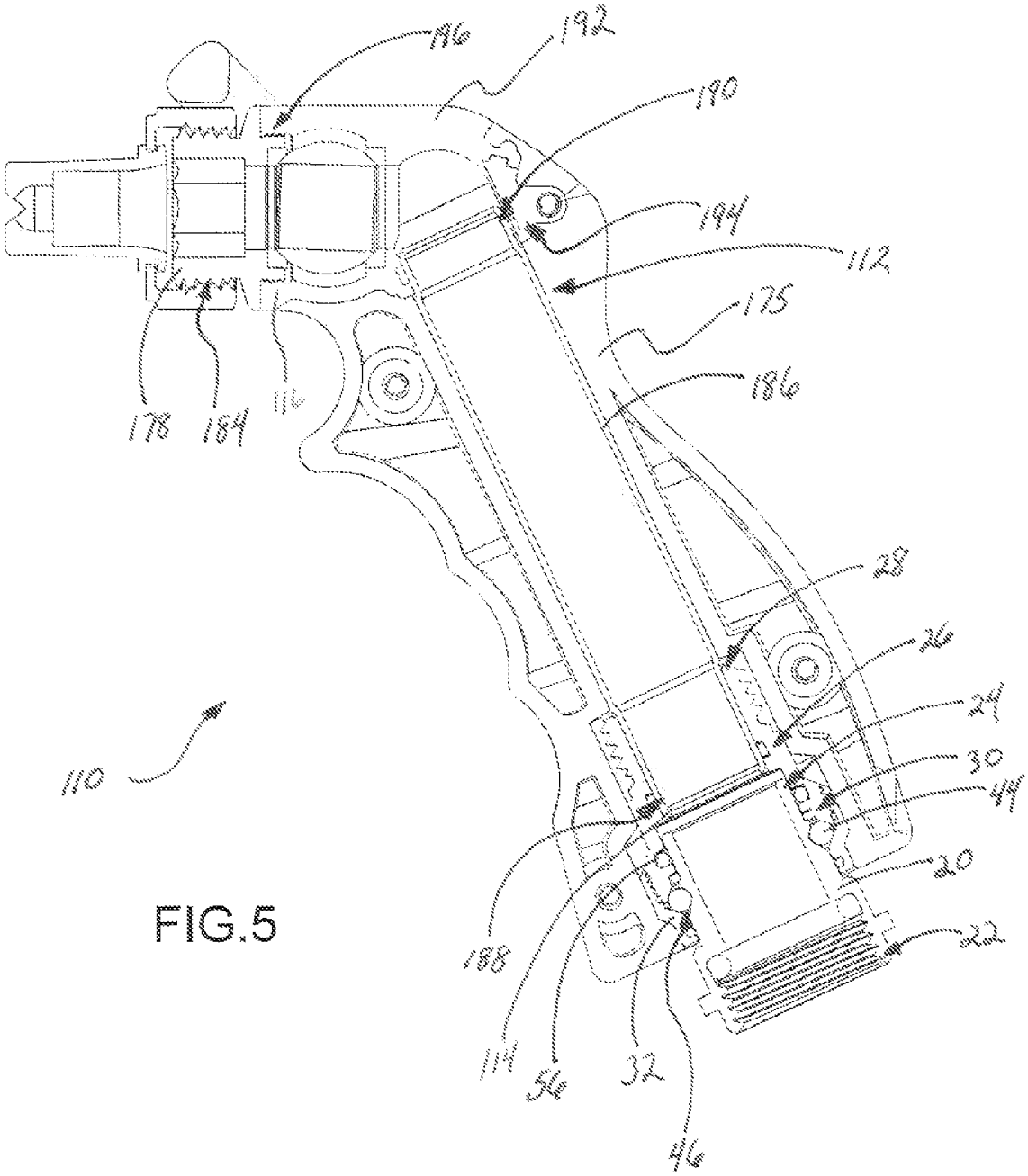
FIG. 5 depicts a cutaway view of the spray gun attachment depicted in FIG. 4.
Figure 6:
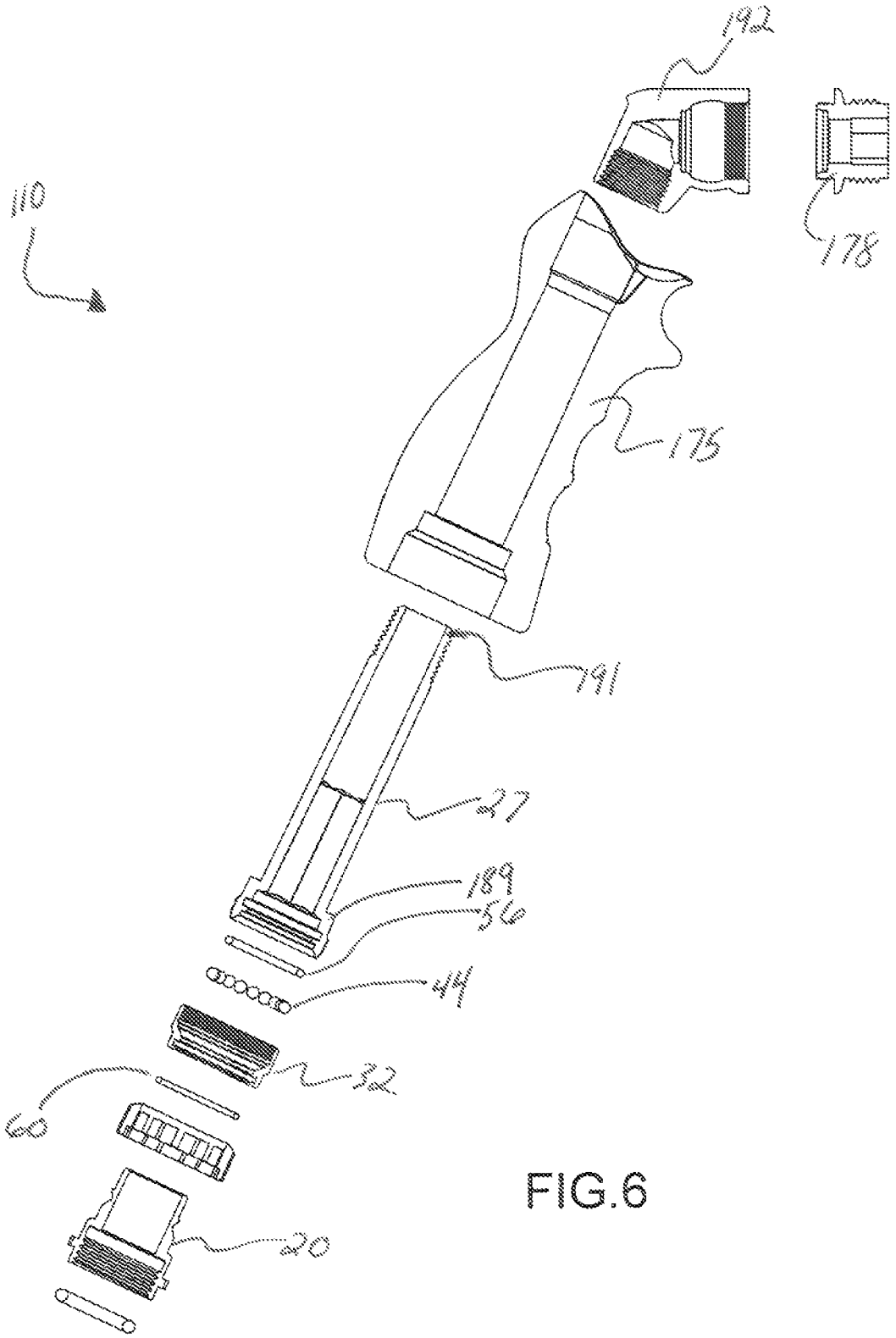
FIG. 6 depicts an exploded view of the spray gun attachment depleted in FIG. 4.

With reference to FIGS. 4-6, the spray gun attachment 110 of the present technology provides a spray gun attachment that is similar to the spray gun attachment 10 but provides alternate structural and/or functional details. For example, the spray gun attachment includes an elongated gun body 112, having an open inlet end portion 114 and an open outlet end portion 116. A fluid pathway extends between the open inlet end portion and the open fluid outlet end portion. However, the gun body 112 is formed from multiple components. In particular, a connector tube 186, having an open first end portion 188 and an open second end portion, is provided to extend up the grip portion of the spray gun attachment 110; the first end portion 188 defining the open inlet end portion 114 of the gun body 112. A head portion 192, having an open first end portion 194 and an open second portion 196, is provided to extend along the "barrel" portion of the spray gun attachment 110; the second end portion 196 defining the open outlet end portion 116 of the gun body 112. The second end portion 190 of the connector tube 186 is coupled with the first end portion 194 of the head portion 192. This connection may be facilitated by opposing mating threads or other mechanical fasteners on the connector tube 186 and the head unit 192. However, a friction-fit coupling is also contemplated, which may include the use of one or more adhesives to secure and/or seal the connection. In some embodiments, such as in FIG. 6, the connector tube 186 and the rotor 26 may be provided as a single component, whether through unitary construction or permanent connection. The resulting rotor 27 has a first end portion 189 similar to the first end portion 28 of rotor 20. It also includes an elongated second end portion 191 which serves to couple with the head portion 192 in a manner similar to the connector tube 186.

The gun body 112 may be formed from a wide array of different materials, depending on the intended use and desired durability of the spray gun attachment 110. For example, metals such as brass, aluminum, steel, and various metal blends will provide strength and durability. However, it is contemplated that various plastics may provide suitable durability and uses in particular applications while reducing overall weight as well as materials and manufacturing costs. It is further contemplated that the various components of the gun body 112, such as the connector tube 186 and head portion 188, may be formed from dissimilar materials to reduce the cost, weight and manufacturing complexity of either part.

The open first end portion 188 of the connector tube 186 is coupled with a swivel connector, such as the swivel connector 18 described more fully above. Specifically, the open first end portion 188 of the connector tube 186 is coupled with the open second end portion 30 of the rotor 26. This connection may be facilitated by opposing mating threads or other mechanical fasteners on the connector tube 186 and the swivel connector 18. However, a friction-fit coupling is also contemplated, which may include the use of one or more adhesives to secure and/or seal the connection. Irrespective of the manner in which the opposing structures are secured with one another, the spray gun attachment 110 is secured to, and permitted to rotate with, the housing stem 20 of the swivel connector 18. Inlet mating threads 68 or other mechanical fastener features may be associated with an interior portion of the housing stem 20, adjacent the first end portion 22 of the housing stem 20. The inlet mating threads 68 may be coupled with a terminal end portion of a fluid supply line 70 that extends from a fluid source, such as a faucet. With a fluid supply line coupled with the first end portion 22 of the housing stem 20, a user may grasp the spray gun body 112 and freely pivot the spray gun body 112 with respect to the fluid supply line 70.

As described above with respect to the spray gun attachment 10, the spray gun attachment 110 may be provided with one of various known valve mechanisms for metering the How of fluid through the gun body 112. Such valve mechanisms may be associated with one or more trigger assemblies that are configured so that a user may engage the trigger assembly and actuate the valve mechanism between an open position, a closed position, and points therebetween.

With reference to FIGS. 4-6, various embodiments of the spray gun attachment 10 will be provided with a grip 172. In some embodiments, the grip 172 at least partially surrounds the gun body 112 and the swivel connector 18. In some respects, the grip position provides a degree of security to the point of connection between the gun body 112 and the swivel connector 18. The grip 172 may be formed from a wide array of materials according to the desired use and durability of the spray gun attachment 10. For example, the grip 172 may be formed from various plastic or metal materials. However, one of various natural and synthetic rubber materials, closed and open cell foams, and the like, will provide a grip 172 that is at least semi-deformably resilient and comfortable for users to grip. While it is contemplated that such materials could be over-molded onto the gun body 112 for ease of assembly, some embodiments of the spray gun attachment 110 use a grip 172 that is bifurcated, longitudinally into separate grip halves 173 and 175. The opposing grip halves 173 and 175 have an interior that is specifically formed to receive the components of the gun body 112 and the swivel connector 18. Mechanical fasteners, such as screws 177, may be used to secure the opposing grip halves with one another. However, various adhesives may also be used in particular applications where removal of the grip 172 is less desirable. Regardless of the manner in which grip 172 is formed, the grip 172 will be economically shaped to fit within a user's hand, including a slightly curved spine 174, which is received within a user's palm, and recesses 176 that receive the user's fingers.

As described above with respect to the spray gun attachment 10, the spray gun attachment 110, in various embodiments, is provided with a spray tip adapter 178 at the outlet end portion 116 of the gun body 112. In at least some embodiments, the spray tip adapter 178 is provided as a separate, removable component that is secured with the outlet end portion 116 using mating threads or other suitable mechanical fasteners. An open second end portion 82 of the spray tip adapter 178 includes tip mating threads 84 or other mechanical fasteners that are configured to receive the mating threads of a spray tip, such as various off the shelf garden hose spray tips and accessories. However, it is contemplated that the second end portion 82 may be provided in nearly any shape and configuration to receive different attachments in a wide array of applications.

Although the spray gun attachments and methods of employing the same have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a staled range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A spray gun for fluid supply lines in a fluid handling system, the spray gun comprising:

an elongated gun body having an open inlet end portion and an open outlet end portion and an open fluid pathway extending between the inlet end portion and outlet end portion;

a tip adapter removably coupled with the output end portion of the gun body; the tip adapter and output end portion of the gun body defining a valve housing;

a valve mechanism disposed within the valve housing; the valve housing adapted to selectively control fluid flow from the outlet end portion of the gun body and the tip adapter; the valve being sized to be selectively removed from within the valve housing when the tip adapter is not coupled with the output end portion of the gun body;

a swivel connector including:

a rotor having an open first end portion, an open second end portion and an open fluid pathway extending between the first and second end portions;

a housing stem having an open first end portion, an open second end portion, and a fluid pathway extending between the first and second end portions; the first end portion of the housing stem being in open fluid communication with the second end portion of the rotor, whereby the open fluid pathway of the rotor is in open fluid communication with the housing;

a bearing cup having an open housing stem end portion, an open rotor end portion, and an open interior portion; the rotor end portion of the bearing cup being operatively coupled with an exterior surface of the rotor between the first and second end portions of the rotor; the housing stem end portion of the bearing cup being operatively coupled with an exterior surface of the housing stem between the first and second end portions of the housing stem; and a bearing assembly having a bearing raceway with surfaces that are at least partially defined by a channel, a bearing wall, and an interior bearing wall within the interior portion of the bearing cup;

the second end portion of the rotor being operatively coupled with the inlet end portion of the gun body, whereby the open fluid pathway of the rotor is in open fluid communication with the open fluid pathway of the gun body, and the rotor and gun body may together freely rotate with respect to the housing stem.

2. The spray gun of claim 1 wherein the bearing raceway surfaces are defined by flat surfaces on each of: the bearing channel, the bearing wall, and the interior bearing wall within the interior portion of the bearing cup.

3. The spray gun of claim 2 wherein the bearing channel is formed to have a V-shape, having flat opposing first and second walls.

4. The spray gun of claim 1 wherein, the bearing channel is formed in the exterior surface of the housing stem, and the bearing wall is formed in the first end portion of the rotor.

5. The spray gun of claim 1 further comprising an O-ring seal positioned between the housing stem and the rotor, whereby the passage of fluid from the fluid pathway of the housing stem to the interior portion of the bearing cup is substantially prevented.

6. The spray gun of claim 5 wherein the O-ring seal is positioned within an annular recess formed in an interior surface of the rotor, adjacent the first end portion of the rotor.

7. The spray gun of claim 5 further comprising an O-ring dust seal disposed between the exterior surface of the housing stem and the housing stem end portion of the bearing cup wherein the O-ring dust seal is at least partially disposed within an annular recess formed within an interior surface of the bearing cup.

8. The spray gun of claim 1 wherein:

the first end portion of the housing stem is provided with mating threads adapted to be operatively connected to a first fluid supply line; and the second end portion of the rotor is provided with mating threads adapted to be threadably connected to mating threads on the inlet end portion of the gun body.

9. The spray gun of claim 1 further comprising:

a grip at least partially surrounding: (i) the gun body; and (ii) the swivel connector; the grip being ergonomically shaped to fit within a user's hand.

10. The spray gun of claim 9 wherein the grip is divided along a long axis of the grip to define a left side portion of the grip and a right side portion of the grip; the left side portion and a right side portion of the grip being operatively secured with one another.

11. The spray gun of claim 9 wherein the left side portion and a right side portion of the grip are secured with one another using one or more mechanical fasteners.

12. The spray gun of claim 1 further comprising:

the tip adapter having tip mating threads that are configured to receive the mating threads of a spray tip.

13. The spray gun of claim 12 wherein the tip adapter includes mounting threads that are configured to removably couple with mating threads disposed on the output end portion of the gun body.

14. A spray gun for fluid supply lines in a fluid handling system, the spray gun comprising:

an elongated gun body having an open inlet end portion and an open outlet end portion and an open fluid pathway extending between the inlet end portion and outlet end portion;

a swivel connector including:

a rotor having an open first end portion, an open second end portion and an open fluid pathway extending between the first and second end portions;

a housing stem having an open first end portion, an open second end portion, and a fluid pathway extending between the first and second end portions; the first end portion of the housing stem being in open fluid communication with the second end portion of the rotor, whereby the open fluid pathway of the rotor is in open fluid communication with the housing;

a bearing cup having an open housing stem end portion, an open rotor end portion, and an open interior portion; the rotor end portion of the bearing cup being operatively coupled with an exterior surface of the rotor between the first and second end portions of the rotor; the housing stem end portion of the bearing cup being operatively coupled with an exterior surface of the housing stem between the first and second end portions of the housing stem; and a bearing assembly having a bearing raceway with surfaces that are at least partially defined by flat surfaces on each of: a bearing channel; a bearing wall; and an interior bearing wall within the interior portion of the bearing cup; the bearing channel formed to have a V-shape, having flat opposing first and second walls; the bearing wall and the interior bearing wall within the interior portion of the bearing cup are flat, opposing surfaces that together generally define a V-shape that is open toward an open end portion of the bearing channel;

the second end portion of the rotor being operatively coupled with the inlet end portion of the gun body, whereby the open fluid pathway of the rotor is in open fluid communication with the open fluid pathway of the gun body, and the rotor and gun body may together freely rotate with respect to the housing stem.

15. A spray gun for fluid supply lines in a fluid handling system, the spray gun comprising:

an elongated gun body having an open inlet end portion and an open outlet end portion and an open fluid pathway extending between the inlet end portion and outlet end portion;

a swivel connector including:

a rotor having an open first end portion, an open second end portion and an open fluid pathway extending between the first and second end portions;

a housing stem having an open first end portion, an open second end portion, and a fluid pathway extending between the first and second end portions; the first end portion of the housing stem being in open fluid communication with the second end portion of the rotor, whereby the open fluid pathway of the rotor is in open fluid communication with the housing;

a bearing cup having an open housing stem end portion, an open rotor end portion, and an open interior portion; the rotor end portion of the bearing cup being operatively coupled with an exterior surface of the rotor between the first and second end portions of the rotor; the housing stem end portion of the bearing cup being operatively coupled with an exterior surface of the housing stem between the first and second end portions of the housing stem; and a bearing assembly having a bearing raceway with surfaces that are at least partially defined by a channel, a bearing wall, and an interior bearing wall within the interior portion of the bearing cup;

the second end portion of the rotor being operatively coupled with the inlet end portion of the gun body, whereby the open fluid pathway of the rotor is in open fluid communication with the open fluid pathway of the gun body, and the rotor and gun body may together freely rotate with respect to the housing stem;

the gun body comprising a connector tube, having an open first end portion and an open second end portion, and a head portion, having an open first end portion and an open second end portion; the open first end portion of the connector tube being operatively coupled with the open second end portion of the rotor; the open second end portion of the connector tube being operatively coupled with the open first end portion of the head portion; an open fluid pathway extending from the open first end portion of the connector tube through the open second end portion of the head portion.

16. The spray gun of claim 15 further comprising:

a tip adapter disposed at the open second end portion of the head portion of the gun body; the tip adapter having tip mating threads that are configured to receive the mating threads of a spray tip.

17. A spray gun for fluid supply lines in a fluid handling system, the spray gun comprising:

an elongated, tube-shaped gun body having an open inlet end portion and an open outlet end portion and an open fluid pathway extending between the inlet end portion and outlet end portion;

a grip coupled with and at least partially surrounding the gun body; the grip being ergonomically shaped to be gripped within a user's hand;

a swivel connector including:

a rotor having an open first end portion, an open second end portion and an open fluid pathway extending between the first and second end portions;

a housing stem having an open first end portion, an open second end portion, and a fluid pathway extending between the first and second end portions; the first end portion of the housing stem being rotatably coupled with the second end portion of the rotor; the first end portion of the housing stem being in open fluid communication with the second end portion of the rotor, whereby the open fluid pathway of the rotor is in open fluid communication with the housing;

the second end portion of the rotor being operatively coupled with the inlet end portion of the gun body, whereby the open fluid pathway of the rotor is in open fluid communication with the open fluid pathway of the gun body, and the rotor and gun body may together freely rotate with respect to the housing stem.

18. The spray gun of claim 17 wherein the grip at least partially surrounds: (i) the tube-shaped gun body; and (ii) the swivel connector.

19. The spray gun of claim 17 wherein the grip is divided along a long axis of the grip to define a left side portion of the grip and a right side portion of the grip; the left side portion and the right side portion of the grip being operatively secured with one another.

20. The spray gun of claim 17 wherein the grip is overmolded to the tube-shaped gun body.

21. The spray gun of claim 17 wherein the tube-shaped gun body is of unitary construction.

22. The spray gun of claim 17 wherein the tube-shaped gun body includes a connector tube, having an open first end portion and an open second end portion, and a head portion, having an open first end portion and an open second end portion; the open first end portion of the connector tube being operatively coupled with the open second end portion of the rotor; the open second end portion of the connector tube being operatively coupled with the open first end portion of the head portion; an open fluid pathway extending from the open first end portion of the connector tube through the open second end portion of the head portion.

* * * * *